United States Patent [19]

Schermerhorn

[11] 4,323,027

[45] Apr. 6, 1982

[54] TRIM TAB FOR POWER BOAT

[76] Inventor: William H. Schermerhorn, R.D. #2, Hammond, N.Y. 13646

[21] Appl. No.: 162,302

[22] Filed: Jun. 23, 1980

[51] Int. Cl.[3] ..... B63B 1/20

[52] U.S. Cl. ..... 114/285

[58] Field of Search ..... 114/285, 286, 287, 145 R, 114/284

[56] References Cited

U.S. PATENT DOCUMENTS

| | | | |
|---|---|---|---|
| 2,928,365 | 3/1960 | Moon | 114/285 X |
| 3,124,094 | 3/1964 | Braten | 114/284 |
| 3,601,078 | 8/1971 | Bedford, Jr. | 114/285 |
| 3,602,178 | 8/1971 | White | 114/285 |

*Primary Examiner*—Sherman D. Basinger

*Attorney, Agent, or Firm*—Stonebraker, Shepard & Stephens

[57] ABSTRACT

The inventive trim tab 10 is formed of a single piece of tough, rigid resin providing an integral mounting plate 12 and a lifter 11 extending aft from a bottom region of a power boat transom 15. Mounting plate 12 is formed flat to fit against the transom. Lifter 11 extends aft from mounting plate 12 at about a right angle and has a trailing region curving down around a transverse axis aft of the mounting plate and below the lifter. A pair of semitubular surfaces 25 incline from an upper region of mounting plate 12 down to the curved region of the lifter. Lifter 11 also has side edges 20 that extend downwardly and run aft from the transom and has a downwardly extending ridge 21 that runs aft between semitubular surfaces 25.

8 Claims, 3 Drawing Figures

TRIM TAB FOR POWER BOAT

BACKGROUND

Power boats have used stern trim tabs to provide extra stern lift to help adjust the boat to the desired trim while underway. Although trim tabs have been made in many different shapes and have been applied to boats in many ways, only a small percentage of existing boats have ever used trim tabs.

In experimenting with trim tabs, I have devised an improved shape that is both simple and economical to make and install and also is highly effective in use; and I have found that a low cost addition of my trim tabs to existing boats can bring these boats to a plane at a lower engine rpm that would otherwise be required. This saves fuel and improves boat performance.

SUMMARY OF THE INVENTION

My trim tabs mount to extend aft from the bottom region of a power boat transom, and each trim tab is formed of a single piece of tough and substantially rigid resin providing an integral mounting plate and lifter. The mounting plate is flat for fitting against the transom, and the lifter extends aft from the mounting plate at about a right angle. A trailing region of the lifter curves downwayd around a transverse axis spaced aft from the mounting plate and disposed below the lifter, and the lifter has a pair of semitubular surfaces inclined from an upper region of the mounting plate to the downward curve of the lifter. Side edges of the lifter running aft from the transom are formed to extend downwardly, and the lifter has a downwardly extending ridge running aft between the semitubular surfaces. Such trim tabs can be vacuum formed at low cost and can be simply screwed to the transoms of power boats to improve performance substantially for a small investment.

DRAWINGS

DETAILED DESCRIPTION

Figure 1:
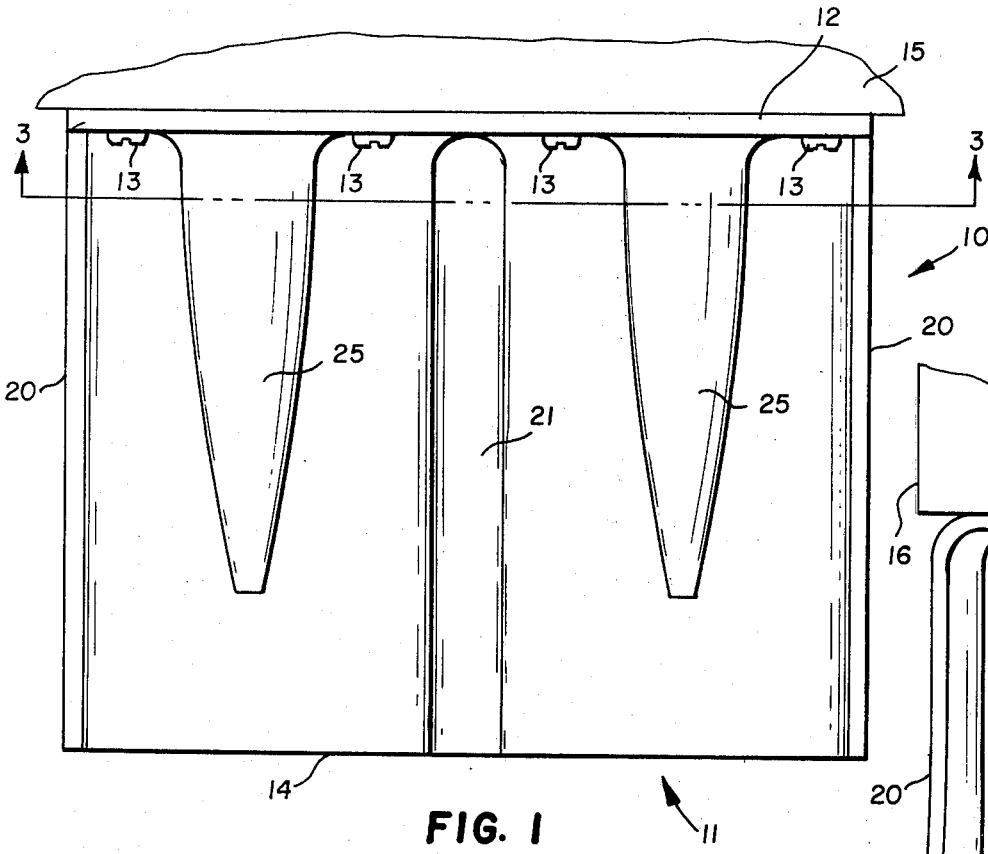
FIG. 1 is a top view of a preferred embodiment of my trim tab fastened to the transom of a boat.
Figure 2:
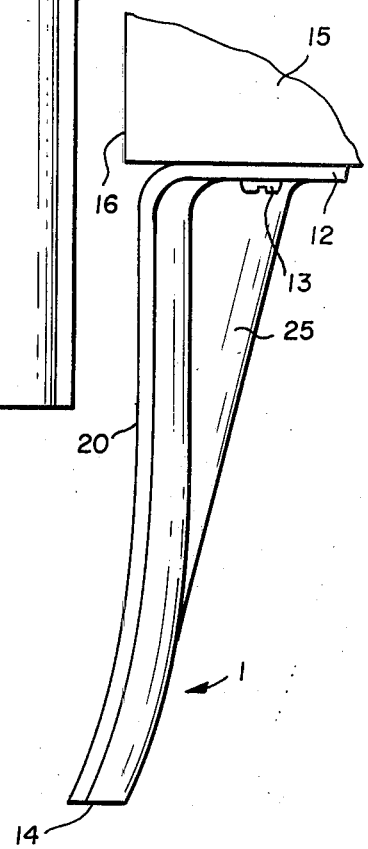
FIG. 2 is a side elevational view of the trim tab of FIG. 1.
Figure 3:
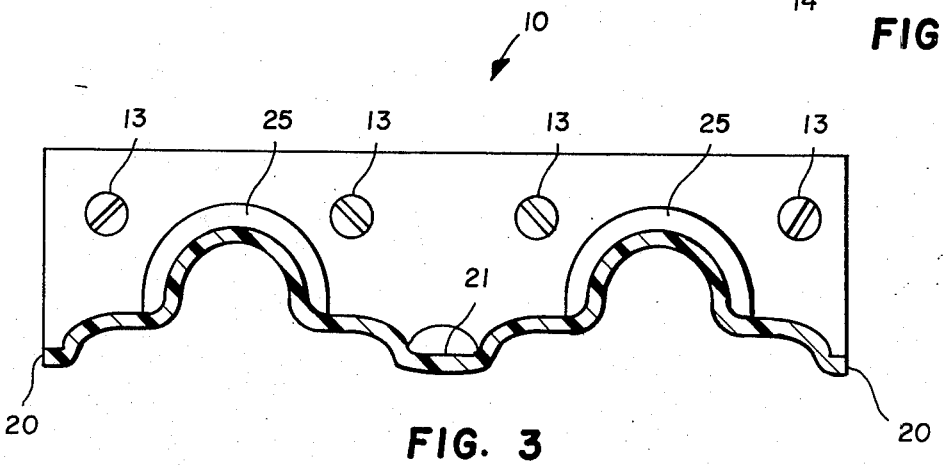
FIG. 3 is a cross-sectional view of the trim tab of FIG. 1 taken along the line 3—3 thereof.

The illustrated trim tab 10 has a preferred shape giving it several advantages including simplicity, low cost, and effectiveness, It can be vacuum formed of a tough, durable, and substantially rigid resin material to have both a low cost and a long life. Its configuration makes it strong and effective, durable in use, and highly efficient in improving a boat's trim, reducing engine rpm, and conserving fuel.

Trim tab 10 is formed of a single piece of resin material providing an integral mounting plate 12 and lifter 11. Mounting plate 12 is generally flat to fit against transom 15 so that tab 10 can be secured to a boat simply by screws 13.

For boats up to about 22 feet long, a pair of tabs 10 are secured on port and starboard sides of transom 15 slightly above boat bottom 16; and for larger boats, two pairs of tabs 10 can be used. The bottoms of tabs 10 are preferably spaced about ½ inch above boat bottom 16 for boats up to 16 feet long; and for every additional 2 feet of boat length, tabs 10 are preferably moved downward by ⅛ inch closer to boat bottom 16 until tabs 10 are aligned with the boat bottom at boat lengths of 22 feet or more. The clearances of tabs 10 from boat bottom 16 are reduced from the preferred ranges by ⅛ inch for flat bottom boats.

Lifter 11 extends aft from mounting plate 12 at approximately a right angle for a distance of about 3 inches and then curves downwardly as illustrated. The downward curvature of lifter 11 is formed around transverse axis spaced aft from mounting plate 12 and disposed below lifter 11. The transverse curvature axis is preferably located about 3 inches aft of mounting plate 12 and far enough below lifter 11 so that the radius of downward curvature of lifter 11 is about 13 to 14 inches. This downward curvature provides dynamic lift as tab 10 is driven through the water at the stern of a boat to help lift the boat onto a plane.

Side edges 20 running aft along opposite sides of lifter 11 extend downward from the general plane of lifter 11, preferably by about ½ inch. The downward extension of side edges 20 preferably extends along the full length of lifter 11 and bends to curve downward with lifter 11 around the same transverse axis of curvature.

A central ridge 21 also extends downward from the general plane of lifter 11 and runs straignt aft along the center line of lifter 11. Ridge 21 preferably extends downward approximately equally with side edges 20, and edges 20 and reidge 21 strengthen and reinforce lifter 11 and provide extra lifting surfaces aligned with the relative water flow under lifter 11.

A pair of semitubular surfaces 25 are formed in lifter 11 to incline from an upper region of mounting plate 12 downward to the curved region of lifter 11 as illustrated. Surfaces 25 are preferably formed as generally cylindrical surfaces that are approximately tangent to the downward curve of lifter 11 at about three-quarters of the distance from mounting plate 12 to the trailing edge 14 of lifter 11.

Semitubular surfaces 25 serve as gussets bracing and strengthening lifter 11 relative to mounting plate 12 and the boat to which it is attached so that lifter 11 maintains its position during operation. Surfaces 25 also provide tapered hollow spaces on the underside of lifter 11 to direct water toward the downwardly curved portion of lifter 11, and thus provide extra hydrodynamic lifting surfaces.

Semitubular surfaces 25, downwardly extending ridge 21 between these surfaces, and side edges 20 all cooperate with the remainder of lifter 11 to maintain the downward curvature of the trailing region of lifter 11 and provide a substantial hydrodynamic lift in a small area. These configurations also strengthen and support lifter 11 relative to mounting plate 12 so that tab 10 can give a power boat a substantial stern lift at a low cost. These features allow trim tabs 10 to pay for themselves in fuel savings within a short period of time.

I claim:

1. A trim tab for mounting to extend aft from a bottom region of a transom of a power boat, said trim tab comprising:

a. a single piece of tough and substantially rigid resin material formed with an approximately uniform thickness to provide an integral mounting plate and lifter;

b. said mounting plate being flat for fitting against said transom;

c. a forward region of said lifter extending straight aft from said mounting plate at about a right angle to said mounting plate;

d. said lifter curving downward in a trailing region aft of said forward region, and said downward curve of said lifter being formed around a transverse axis spaced aft from said mounting plate and said forward region and disposed below said lifter;

e. said forward region of said lifter having raised and spaced apart semitubular surfaces inclined to extend from an upper region of said mounting plate downward to join said downward curve of said trailing region of said lifter;

f. approximately parallel side edges of said lifter running straight aft from said transom being formed to extend downwardly; and g. said lifter having a downwardly extending ridge running straight aft between said semitubular surfaces and approximately parallel with said side edges.

2. The trim tab of claim 1 wherein said side edges and said ridge extend downwardly by approximately equal amounts.

3. The trim tab of claim 1 wherein said semitubular surfaces are generally cylindrical and approximately tangent to said downward curve of said lifter at about three-quarters of the distance from said mounting plate to the trailing end of said lifter.

4. The trim tab of claim 1 wherein said transverse axis of curvature is located about 3 inches aft of said mounting plate where said forward region joins said trailing region, and the radius of said curvature is about 13–14 inches.

5. The trim tab of claim 1 wherein said side edges and said ridge curve downwardly with said trailing region of said lifter around said transverse axis.

6. The trim tab of claim 5 wherein said semitubular surfaces are generally cylindrical and approximately tagent to said downward curve of said lifter at about three-quarters of the distance from said mounting plate to the trailing end of said lifter.

7. The trim tab of claim 6 wherein said transverse axis of curvature is located about 3 inches aft of said mounting plate where said forward region joins said trailing region, and the radius of said curvature is about 13–14 inches.

8. The trim tab of claim 7 wherein said side edges and said ridge extend downwardly by approximately equal amounts.

* * * * *